US008643543B2

(12) United States Patent
McKay et al.

(10) Patent No.: US 8,643,543 B2
(45) Date of Patent: Feb. 4, 2014

(54) PHASED ARRAY ANTENNA SYSTEM WITH INTERMODULATION BEAM NULLING

(75) Inventors: James P. McKay, Hermosa Beach, CA (US); David A. Ksienski, Los Angeles, CA (US)

(73) Assignee: The Aerospace Corporation, El Segundo, CA (US)

( * ) Notice: Subject to any disclaimer, the term of this patent is extended or adjusted under 35 U.S.C. 154(b) by 144 days.

(21) Appl. No.: 12/879,962

(22) Filed: Sep. 10, 2010

(65) Prior Publication Data

US 2012/0062425 A1 Mar. 15, 2012

(51) Int. Cl.
*H01Q 3/26* (2006.01)

(52) U.S. Cl.
USPC ..... 342/372; 342/383

(58) Field of Classification Search
USPC ..... 342/367, 368–377, 383
See application file for complete search history.

(56) References Cited

U.S. PATENT DOCUMENTS

| | | | | |
|---|---|---|---|---|
| 4,498,083 | A * | 2/1985 | Gutleber | 342/380 |
| 5,412,414 | A * | 5/1995 | Ast et al. | 342/174 |
| 6,496,158 | B1 | 12/2002 | Ksienski et al. | |
| 7,064,710 | B1 | 6/2006 | Ksienski et al. | |
| 7,098,848 | B2 | 8/2006 | Ksienski et al. | |
| 7,256,649 | B2 | 8/2007 | Ksienski et al. | |
| 7,420,508 | B2 | 9/2008 | Ksienski et al. | |

* cited by examiner

*Primary Examiner* — Cassie Galt
(74) *Attorney, Agent, or Firm* — Paul D. Chancellor; Ocean Law

(57) ABSTRACT

A phased array antenna system with intermodulation beam nulling device includes nulling phase shifters.

10 Claims, 10 Drawing Sheets

PHASED ARRAY ANTENNA SYSTEM WITH INTERMODULATION BEAM NULLING

GOVERNMENT INTEREST

This invention was made with government support under Contract No. FA8802-04-C-0001 awarded by the Department of the Air Force. The government has certain rights in the invention.

BACKGROUND OF THE INVENTION

1. Field of the Invention

The present invention relates to improving transmitted signal quality in an active phased array antenna utilizing solid state power amplifiers transmitting two or more fundamental communications beams. In particular, selected intermodulation beams arising from nonlinear amplifier operation are nulled to improve signal quality.

2. Discussion of the Related Art

Active phased array antennas include a plurality of radiators driven by respective amplifiers. FIG. 1 shows a prior art active phased antenna 100. The antenna has radiators 120 located at the intersections of lines of a corresponding x-y rectangular grid. Radiators may be located in the grid by reference to an (x,y) coordinate such as (1,1) or (3,3). This two coordinate referencing system is used in some antenna equations. Another coordinate referencing system uses one coordinate, each element being sequentially numbered. For example, in a 3×3 array, element (1,1) becomes element 1 and element 3,3 becomes element 9. This referencing system is used in some antenna equations.

FIG. 2A shows a prior art active phased array antenna 200A. A beam forming section incorporating "i" beam forming elements 250 is coupled with signal(s) 224 and commanded angle inputs 222. Signal(s) with an applied phase shift for beam steering 255 are outputs of the beam forming section and are coupled to the feed chain section incorporating "i" feed chain elements 254. Feed chain section outputs 257 are coupled to "i" radiators 220 of an antenna array 260.

FIG. 2B shows a more detailed version 200B of the prior art active phased array of FIG. 2A. Here, an $i^{th}$ radiator 220 is coupled with incoming signals $S_1$, $S_2$ via an $i^{th}$ antenna beam forming element 204 of beam forming section 250 and an $i^{th}$ feed chain element 205 of feed chain section 254. In this embodiment, a fundamental beam steering processor 202 is common to a plurality of antenna beam forming sections.

As used herein, the term processor refers to a device for processing information. In particular, digital processors such as microprocessors and other digital processing devices are included. Various processor embodiments include one or more processors. And, some processor embodiments include one or more memory device(s) such as semiconductor and/or hard disc drive memory devices and input/output device(s) such as bus communications, parallel communications, and serial communications devices.

Beam forming section inputs include a plurality of signals 224 and their related angles 222. For each signal $S_1$, $S_2$, two angles, commanded elevation $\theta_0$ and azimuth $\phi_0$ determine the direction of the beam carrying the signal and therefore the intended receiver of the signal. For example, a first fundamental beam might be directed to a receiver in a first city at the angle pair ($\theta_0$, $\phi_0$) and a second fundamental beam might be directed to another receiver in another city at the angle pair ($\theta'_0$, $\phi'_0$). Manipulating the direction of a communication beam is sometimes referred to as steering the beam.

Beam forming entails creation of a phase front for each beam that is normal to the desired direction of the beam. These phase fronts are created by appropriately shifting the phases of the incoming signals $S_1$, $S_2$ in beam forming elements 204. Each one of "i" antenna beam forming elements includes steering phase shifters $PS_{i1}$, $PS_{i2}$ that create corresponding shifted signals $S_{i1a}$, $S_{i2a}$. In various embodiments, the phase shifters include one or both of digital and analog phase shifters.

Phase shifts $Z_{i1}$, $Z_{i2}$ are applied to the signals $S_1$, $S_2$ to create shifted signals $S_{i1a}$, $S_{i2a}$. In an embodiment, the phase shifts are calculated within the fundamental beam steering processor 202. And, in an embodiment, these applied phase shifts are functions of uniform progressive phases $\alpha_x$, $\alpha_y$ as shown in equations 1a,b below.

$$Z_{i1}=q_1(\alpha_{1,x}, \alpha_{1,y}) \quad \text{Equation 1a}$$

$$Z_{i2}=q_2(\alpha'_{1,x}, \alpha'_{1,y}) \quad \text{Equation 1b}$$

As shown in equations 2a-d below, the uniform progressive phases $\alpha_x$x, $\alpha_y$ are determined by the commanded beam angle pairs $\theta_0$, $\phi_0$ and $\theta'_0$, $\phi'_0$.

$$\tan\phi_0 = \frac{\alpha_{1,y}}{\alpha_{1,x}} \quad \text{Equation 2a}$$

$$\sin^2\theta_0 = \frac{\alpha_{1,x}^2 + \alpha_{1,y}^2}{(2\pi d/\lambda)^2} \quad \text{Equation 2b}$$

$$\tan\phi'_0 = \frac{\alpha'_{1,y}}{\alpha'_{1,x}} \quad \text{Equation 2c}$$

$$\sin^2\theta'_0 = \frac{\alpha'^2_{1,x} + \alpha'^2_{1,y}}{(2\pi d/\lambda)^2} \quad \text{Equation 2d}$$

Note, equations 2a-d assume $d_x$=$d_y$=d. This assumption simplifies the analysis and the equations.

Phase shifter outputs $S_{i1a}$ and $S_{i2a}$ are combined and amplified in the $i^{th}$ feed chain element 205 that includes a signal combiner 210 and a solid state amplifier 212. The signal combiner 210 is coupled to the input signals $S_{i1a}$, $S_{i2a}$ and its output 211 is amplified in the amplifier. The $i^{th}$ radiator element 220 is coupled to the amplifier 212 via an amplifier output 213.

SUMMARY OF THE INVENTION

A phased array antenna system includes phase shifters for nulling selected intermodulation beams. In an embodiment, a nulling section is interposed between a beam forming section and a feed chain section and an antenna has a plurality of radiators, each radiator being coupled to a respective amplifier in the feed chain section. Each amplifier is coupled to a respective nulling phase shifter in the nulling section and each nulling phase shifter is coupled to a respective steering phase shifter in the beam forming section. One or more processors are for activating the phase shifters. The phased array antenna system is operative to simultaneously transmit a plurality of signals to respective locations.

In an embodiment, the phased array antenna system includes one or more processors for calculating directivity patterns and one or more memory devices for storing calculated directivity patterns. A signal sampler is for sampling fundamental and intermodulation forward and reflected traveling wave signal levels at the input of each radiator and one or more processors are for updating the stored directivity patterns in accordance with the sample values.

In an embodiment a single processor is used. And, in an embodiment, the beam forming section includes a processor and the nulling section includes a processor.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and descriptions are non-limiting examples of the embodiments they disclose. For example, other embodiments of the disclosed device and/or method may or may not include the features described herein. Moreover, disclosed advantages and benefits may apply only to certain embodiments of the invention and should not be used to limit the disclosed invention.

As used herein, the term "coupled" includes direct and indirect connections. Moreover, where first and second devices are coupled, other devices including active devices may be interposed between them.

Figure 3A:
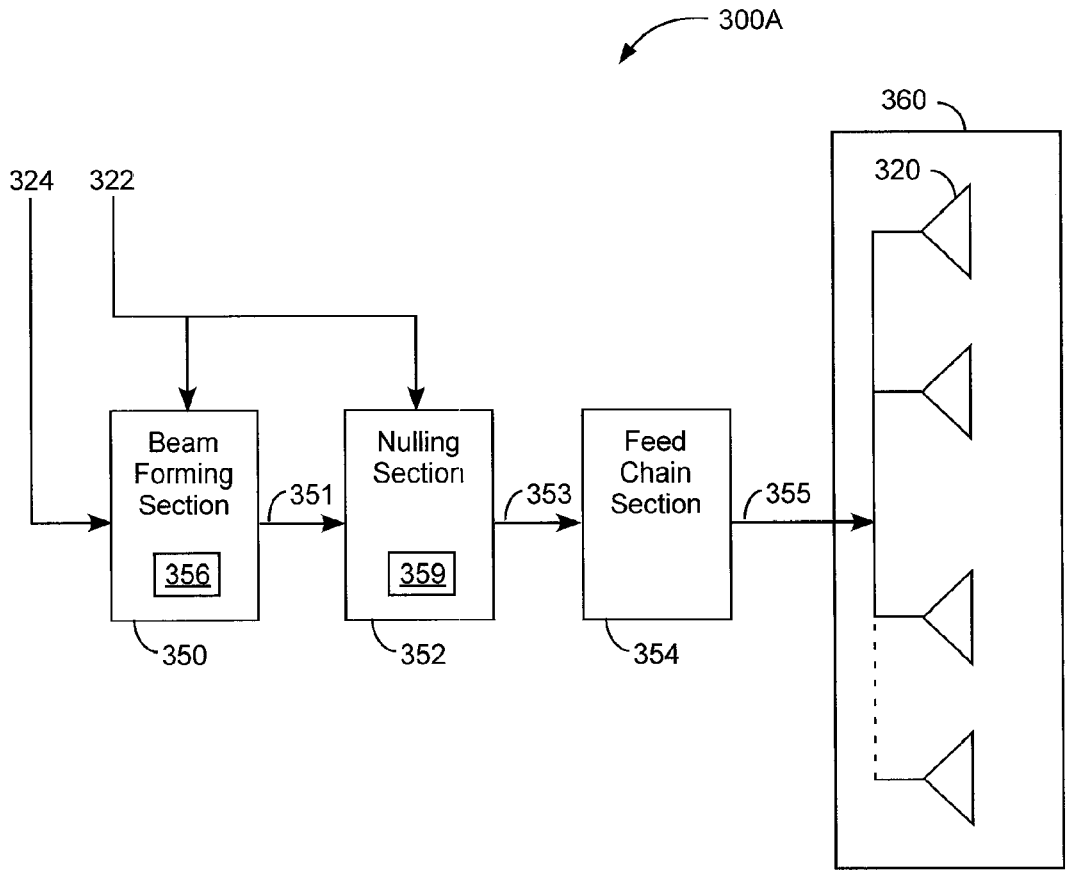
FIG. 3A shows a block diagram of a phased array antenna in accordance with the present invention.

FIG. 3A shows an active array antenna system including a nulling device in accordance with the present invention 300A. A beam forming section incorporating "i" beam forming elements 350 is coupled with signals 324 and commanded angle inputs 322. As persons of ordinary skill in the art will understand, the present invention is applicable where two or more signals are involved. The examples herein utilize two signals to illustrate the invention and not by way of limitation.

A nulling section incorporating "i" nulling elements 352 is coupled with commanded angle inputs 322. Signals with an applied phase shift for beam steering are outputs 351 of the beam forming section and are coupled to the nulling section 352. Nulling section outputs 353 are coupled with a feed chain section incorporating "i" feed chain elements 354. The feed chain section is coupled 355 with "i" radiators 320 of an antenna array 360.

Figure 2A:
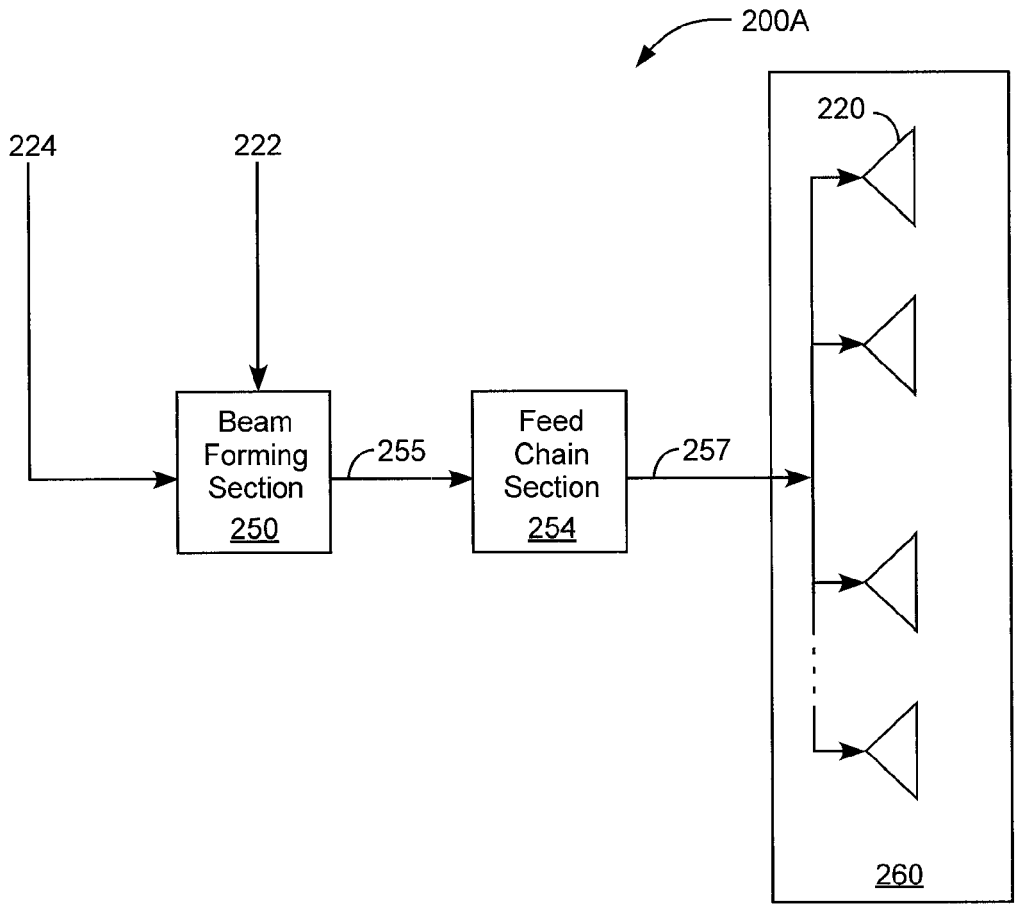
FIG. 2A (Prior Art)
FIG. 2A shows a block diagram of a prior art phased array antenna.

A comparison of FIGS. 2A and 3A shows that present invention improves over the prior art by adding a nulling section to an active phased array antenna system 300A.

Figure 2B:
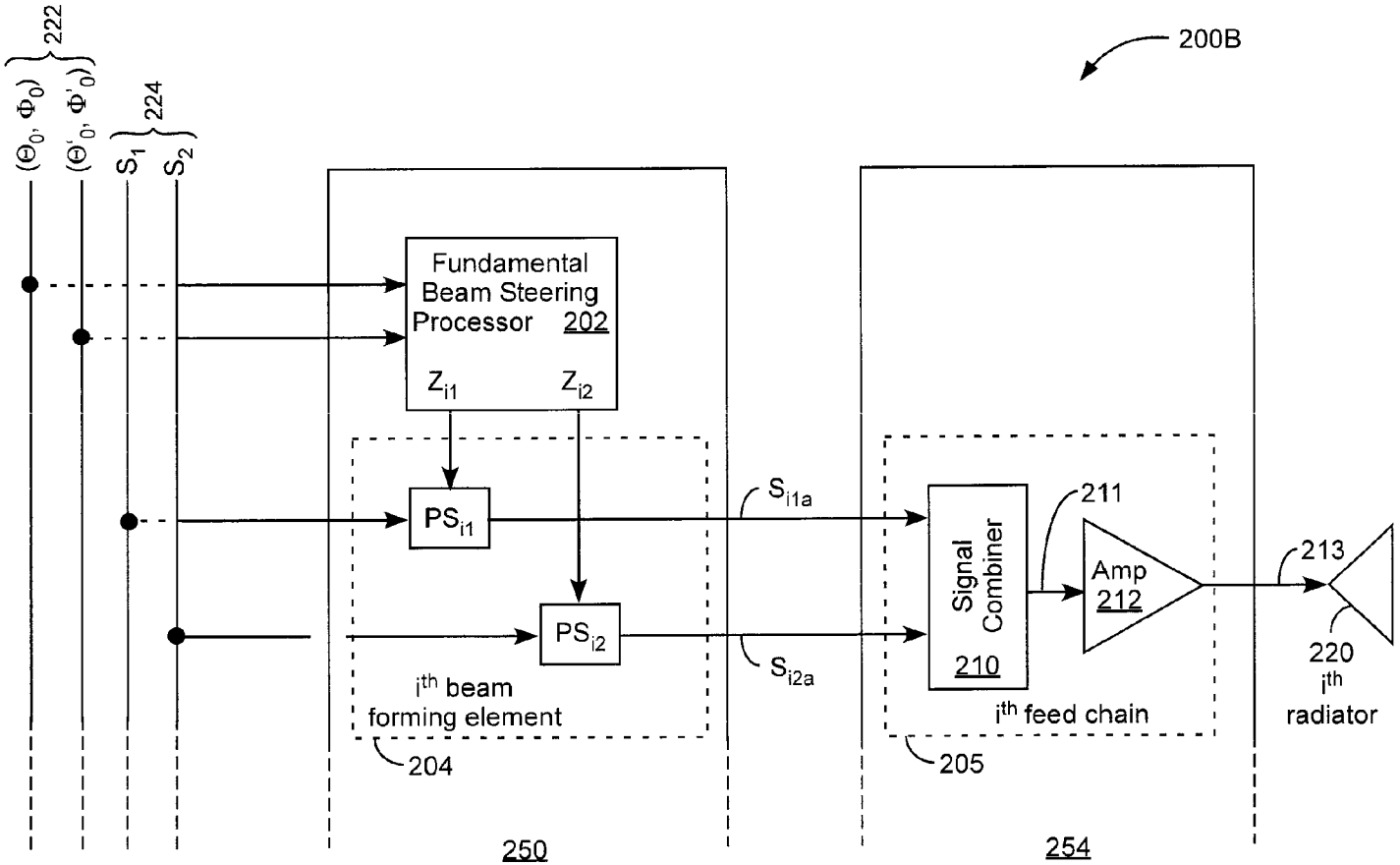
FIG. 2B (Prior Art)
FIG. 2B shows a more detailed version of the block diagram of FIG. 2A.
Figure 3B:
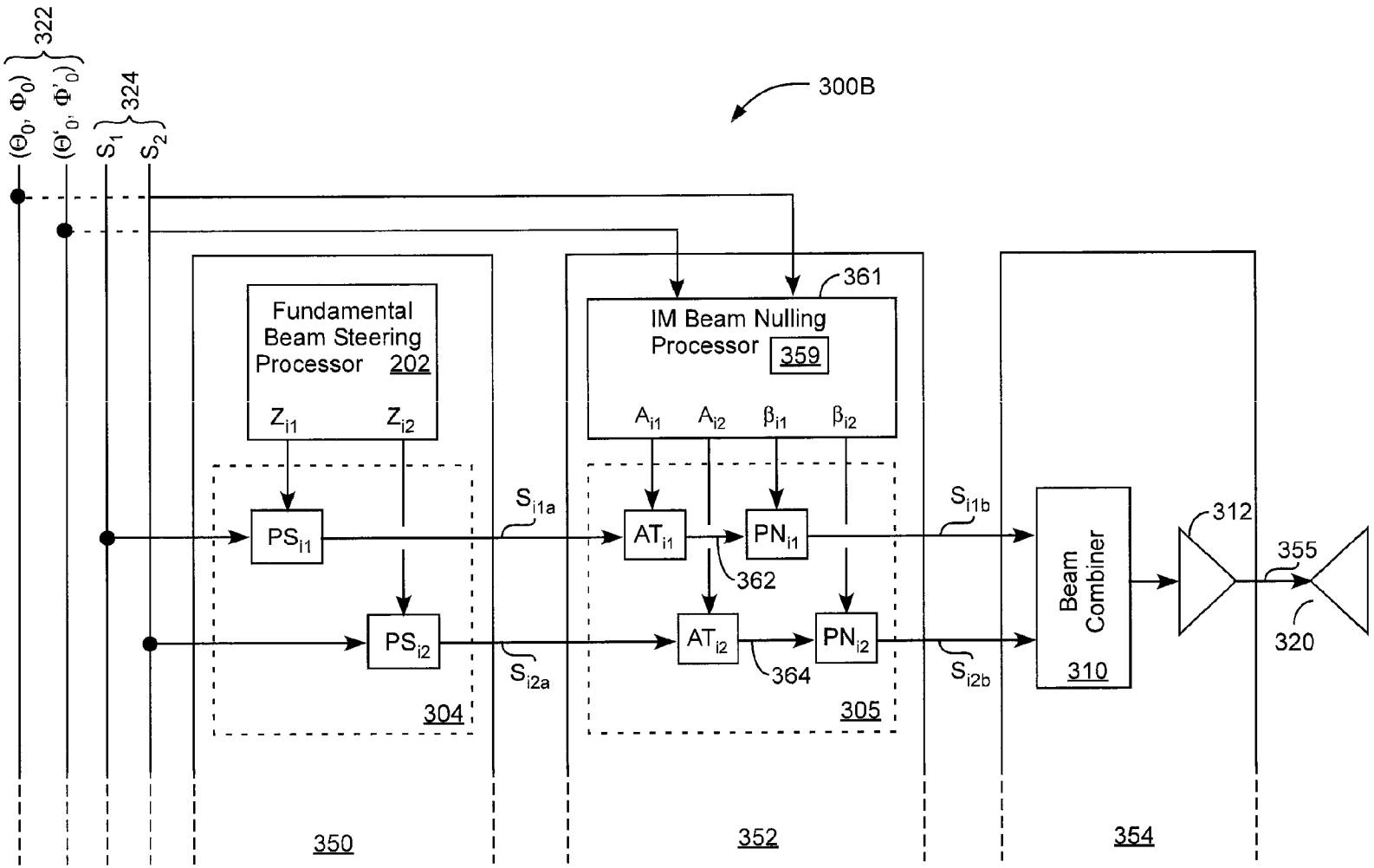
FIG. 3B shows a more detailed version of the block diagram of FIG. 3A.

FIG. 3B shows a more detailed version 300B of the nulling device of FIG. 3A. A beam forming section 350 includes an $i^{th}$ beam forming element 304 and a feed chain section 354 includes an $i^{th}$ beam combiner 310 and an $i^{th}$ amplifier 312. As can be seen, these beam forming and feed chain sections 350, 354 are similar to those discussed above in connection with FIGS. 2A-B. However, unlike the prior art, the steering phase shifter outputs $S_{i1a}$, $S_{i2a}$ are processed a second time in a nulling section 352 that has "i" nulling elements 305 and is located between the beam forming and feed chain sections. As persons of ordinary skill in the art will understand, the nulling section might be located differently with respect to components of the beam forming and feed chain sections.

During operation of the invention's nulling function, attenuators $AT_{i1}$, $AT_{i2}$ are used to equalize radiator amplitudes by applying suitable attenuations $A_{11}$, $A_{12}$, $A_{21}$, $A_{22} \ldots A_{M1}$, $A_{M2}$ (where M represents the number of elements in the array) and nulling phase shifters $PN_{i1}$, $PN_{i2}$ are used to apply a nulling phase distribution. In various embodiments, the phase shifters include one or both of digital and analog phase shifters. Because it is not always beneficial to operate this nulling functionality, embodiments of the invention adapt by selectively operating the nulling function.

When the nulling function is not in operation, a) attenuators $AT_{i1}$, $AT_{i2}$ apply a uniform attenuation to signals such that $A_{11}=A_{21}= \ldots A_{M1}=A_{12}=A_{22}= \ldots =A_{M2}=0$ and b) nulling phase shifters $PN_{i1}$, $PN_{i2}$ apply a uniform phase distribution to signals such that $\beta_{11}=\beta_{21}=\ldots=\beta_{M1}=\beta_{12}=\beta_{22}=\ldots=\beta_{M2}=0$. Adaptive functionality is discussed further below, after operation of the nulling phase shifters has been described.

In the nulling section 352, the once shifted signals $S_{i1a}$, $S_{i2a}$ are attenuated by respective attenuators $AT_{i1}$, $AT_{i2}$ to equalize their levels. Nulling phase shifters $PN_{i1}$, $PN_{i2}$ are provided to process the attenuated signals 362, 364 creating twice shifted signals $S_{i1b}$, $S_{i2b}$. One or more processors perform these functions. In an embodiment, an intermodulation beam nulling processor 361 is coupled to the commanded angle signals 322 and provides a) attenuating outputs $A_{i1}$, $A_{i2}$ coupled to respective attenuators $AT_{i1}$, $AT_{i2}$ and b) phase shifting outputs $\beta_{i1}$, $\beta_{i2}$ coupled to respective phase shifters $PN_{i1}$, $PN_{i2}$.

Nulling unwanted intermodulation beams ("IM" beam or "IMB") entails applying a nulling phase distribution to signals passing through the nulling section 352. The nulling phase distribution shifts the phases of all of the signals $S_{i1a}$, $S_{i2a}$ by a nulling angle $\beta_{u,i}$ with a magnitude of 90/N degrees where N is the order of the intermodulation beam to be nulled. See the appendix to this specification for further explanation of these nulling phase shifts.

Referring to $\beta_{u,i}$ as the nulling phase change for the $u^{th}$ signal and the ith array element, in an exemplary 3×3 phased array antenna, the nulling phase distribution (in degrees) for the first signal is below.

| | | | | | |
|---|---|---|---|---|---|
| $\beta_{1,7}$ | −90/N | $\beta_{1,8}$ | 90/N | $\beta_{1,9}$ | −90/N |
| $\beta_{1,4}$ | 90/N | $\beta_{1,5}$ | −90/N | $\beta_{1,6}$ | 90/N |
| $\beta_{1,1}$ | −90/N | $\beta_{1,2}$ | 90/N | $\beta_{1,3}$ | −90/N |

Similarly, the nulling phase distribution for the second signal is below.

| | | | | | |
|---|---|---|---|---|---|
| $\beta_{2,7}$ | 90/N | $\beta_{2,8}$ | −90/N | $\beta_{2,9}$ | 90/N |
| $\beta_{2,4}$ | −90/N | $\beta_{2,5}$ | 90/N | $\beta_{2,6}$ | −90/N |
| $\beta_{2,1}$ | 90/N | $\beta_{2,2}$ | −90/N | $\beta_{2,3}$ | 90/N |

Figure 4A:
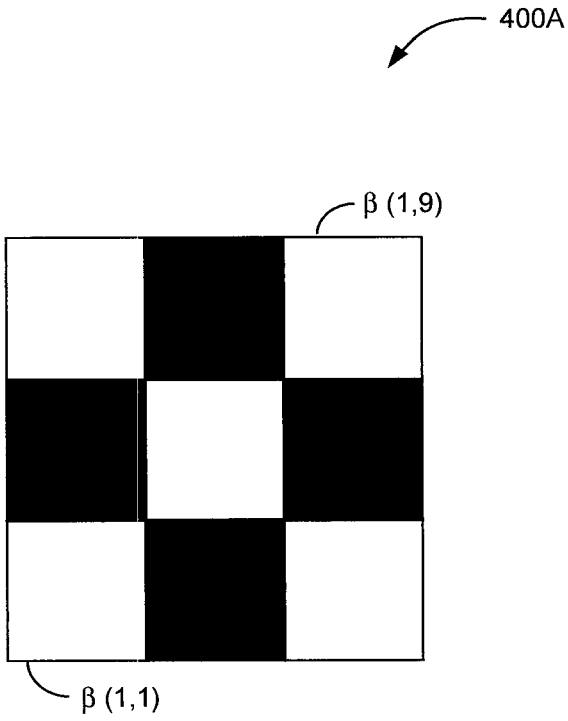
FIGS. 4A-B show selected nulling phase distributions for use with the antenna of FIG. 3A.
Figure 4B:
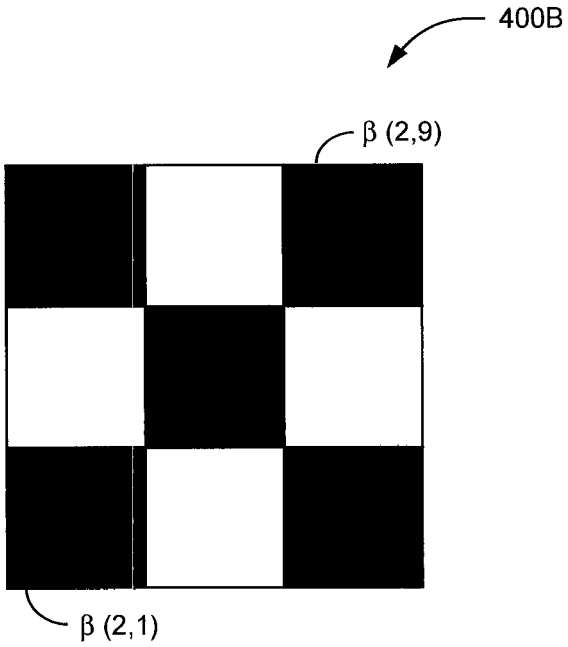

These nulling phase distributions have a "checkerboard" type pattern where each successive element has a phase shift of equal magnitude but of opposite sign. FIGS. 4A and 4B show graphic representations 400A, 400B of these checkerboard nulling phase distributions for signals 1 and 2.

In some embodiments, a single set of phase shifters applies both the steering and the nulling phase shifts. In these embodiments, the steering phase shifts $Z_{i1}$, $Z_{i2}$ are added to the respective nulling phase shifts $\beta_{i1}$, $\beta_{i2}$ and the combined shifts are applied to respective phase shifters. For example, the phase shifts can be combined in a single processor carrying out the functions of the fundamental beam steering processor 202 and the intermodulation beam nulling processor 359.

Turning now to the question of whether nulling phase distributions should be applied, a means for comparing the attenuation of fundamental beams (undesirable) and the attenuation of intermodulation beams (desirable) is required. For example, if application of the nulling phase distribution increases the directivity of selected intermodulation beam(s) while the corresponding fundamental beam is little changed, the application is detrimental.

As shown in Section 2.0 of the appendix, the directivity D of a beam depends on the complex (amplitude and phase) excitation of the $mn^{th}$ element designated $I_{mn}$, elevation and azimuth angles ($\theta$, $\phi$), and the spacing between rows $d_x$ and columns $d_y$ of the phased array. In particular, the peak directivity of the fundamental beams can be expressed as functions of these variables.

$$D_{1st\ fundamental\ beam}=D1F=D(I_{mn},\theta_0,\phi_0,d_x,d_y) \quad \text{Equation 3a}$$

$$D_{2nd\ fundamental\ beam}=D2F=D(I'_{mn},\theta'_0,\phi'_0,d_x,d_y) \quad \text{Equation 3b}$$

The peak directivity of the intermodulation beams of a selected order N also depends on these variables. In particular, the values of progressive phases ($\alpha_{N,x}$, $\alpha_{N,y}$, $\alpha'_{N,x}$, $\alpha'_{N,y}$) corresponding to an $N^{th}$ order intermodulation beam are calculated as indicated below.

$$\alpha_{N,x}=\frac{N+1}{2}\alpha_{1,x}-\frac{N-1}{2}\alpha'_{1,x} \quad \text{Equation 4a}$$

$$\alpha_{N,y}=\frac{N+1}{2}\alpha_{1,y}-\frac{N-1}{2}\alpha'_{1,y} \quad \text{Equation 4b}$$

$$\alpha'_{N,x}=\frac{N+1}{2}\alpha'_{1,x}-\frac{N-1}{2}\alpha_{1,x} \quad \text{Equation 4c}$$

$$\alpha'_{N,y}=\frac{N+1}{2}\alpha'_{1,y}-\frac{N-1}{2}\alpha_{1,y} \quad \text{Equation 4d}$$

To obtain the related intermodulation beam elevation and azimuth scan angles ($\theta_{N,0}$, $\phi_{N,0}$, $\theta'_{N,0}$, $\phi'_{N,0}$), the progressive phase values of equations 4a-d are used in Equations 5a-c (similar to Equations 2a-c) to solve for these values.

$$\tan\phi_{N,0}=\frac{\alpha_{N,y}}{\alpha_{N,x}} \quad \text{Equation 5a}$$

$$\sin^2\theta_{N,0}=\frac{\alpha_{N,x}^2+\alpha_{N,y}^2}{(2\pi d/\lambda)^2} \quad \text{Equation 5b}$$

$$\tan\phi'_{N,0}=\frac{\alpha'_{N,y}}{\alpha'_{N,x}} \quad \text{Equation 5c}$$

$$\sin^2\theta'_{N,0}=\frac{\alpha'^2_{N,x}+\alpha'^2_{N,y}}{(2\pi d/\lambda)^2} \quad \text{Equation 5d}$$

Note, equations 5a-d assume $d_x=d_y=d$. This assumption simplifies the analysis and the equations.

Peak directivity of the intermodulation beams is calculated using the directivity equation discussed above.

$$D_{1st\ intermodulation\ beam}=D1I=D(I_{mn},\theta_N,\phi_N,d_x,d_y) \quad \text{Equation 6a}$$

$$D_{2nd\ intermodulation\ beam}=D2I=D(I'_{mn},\theta_N,\phi_N,d_x,d_y) \quad \text{Equation 6b}$$

Directivities before and after application of the nulling phase distribution can now be calculated and compared.

| | Directivity Before Application Of Nulling Distribution | Directivity After Application Of Nulling Distribution |
|---|---|---|
| $1^{st}$ Fundamental Beam | D1FB | D1FA |
| $2^{nd}$ Fundamental Beam | D2FB | D2FA |
| $1^{st}$ Intermodulation Beam | D1IB | D1IA |
| $2^{nd}$ Intermodulation Beam | D2IB | D2IA |

The objective of nulling is to improve signal quality by targeting a detrimental Nth order intermodulation beam and degrading the directivity of that beam such that either or both of the degradations (D1IB-D1IA) and (D2IB-D2IA) are large by comparison to corresponding fundamental beam degradations (D1FB-D1FA) and (D2FB-D2FA).

Simulations indicate in a 14×14 array with analog phase shifters $PN_{i1}$, $PN_{i2}$ the directivity of any odd-order intermodulation beam can be degraded by about 35 dB at a cost of fundamental beam degradation of less than 0.25 dB. Notably, using present day technology, digital phase shifter performance can be expected to fall short of that of analog devices owing to introduction of analog/digital conversion quantization errors.

In some embodiments, a collection of directivity patterns P are stored in a memory device such as a semiconductor or disc drive memory device. The value of P is the directivity of a particular beam. In some embodiments, the memory device 359 is a part of the intermodulation beam nulling computer 361 and in some embodiments the memory device 356 is a part of the beam forming section 350.

Pre-calculation and storage of directivity patterns avoids the need to calculate directivities after angle commands ($\theta_0$, $\phi_0$), ($\theta'_0$, $\phi'_0$) are given. Among other things, pre-calculation and storage saves time and reduces processor requirements. Notably, where commanded angles differ from stored angles, a selection methodology is required such as selection of the closest stored angle data and/or interpolation of the stored angle data to fit the commanded angles.

As persons of ordinary skill in the art will appreciate, stored directivity patterns P can be referenced in different ways. For example, the stored patterns can be stored in a multidimensional matrix such that $$P=P(j,k,\theta_{0p},\phi_{0p},\theta'_{0q},\phi'_{0q},\theta,\phi)$$

where 1) j is an integer indicating the first fundamental beam (j=1), the second fundamental beam (j=2), the first $3^{rd}$ order IM beam (j=3), the second $3^{rd}$ order IM beam (j=4), the first $5^{th}$ order IM beam (j=4), the second $5^{th}$ order IM beam (j=5), and so on.
2) k is an integer indicating when nulling is applied (k=1) and when nulling is not applied (k=2).

3) $\theta_{0p}$, $\phi_{0p}$ indicate the stored elevation and azimuth angles that are closest to the commanded angles for the first signal $\theta_0$, $\phi_0$.

4) $\theta'_{0p}$, $\phi_{0q}$ indicate the stored elevation an azimuth angles that are closest to the commanded angles for the second signal $\theta'_0$, $'\phi_0$.

5) and, where $\theta$, $\phi$ indicate angles relative to the antenna platform's look angle, for example a spacecraft's look angle toward the earth. Here, the antenna pattern P will vary with $\theta$, $\phi$, such that for example, the peak of the first fundamental pattern occurs at angles $\theta_0$ and $\phi_0$.

In some embodiments, adaptation utilizing radiator feedback updates pattern values P to account for radiator element 320 changes such as radiator degradation.

Figure 5:
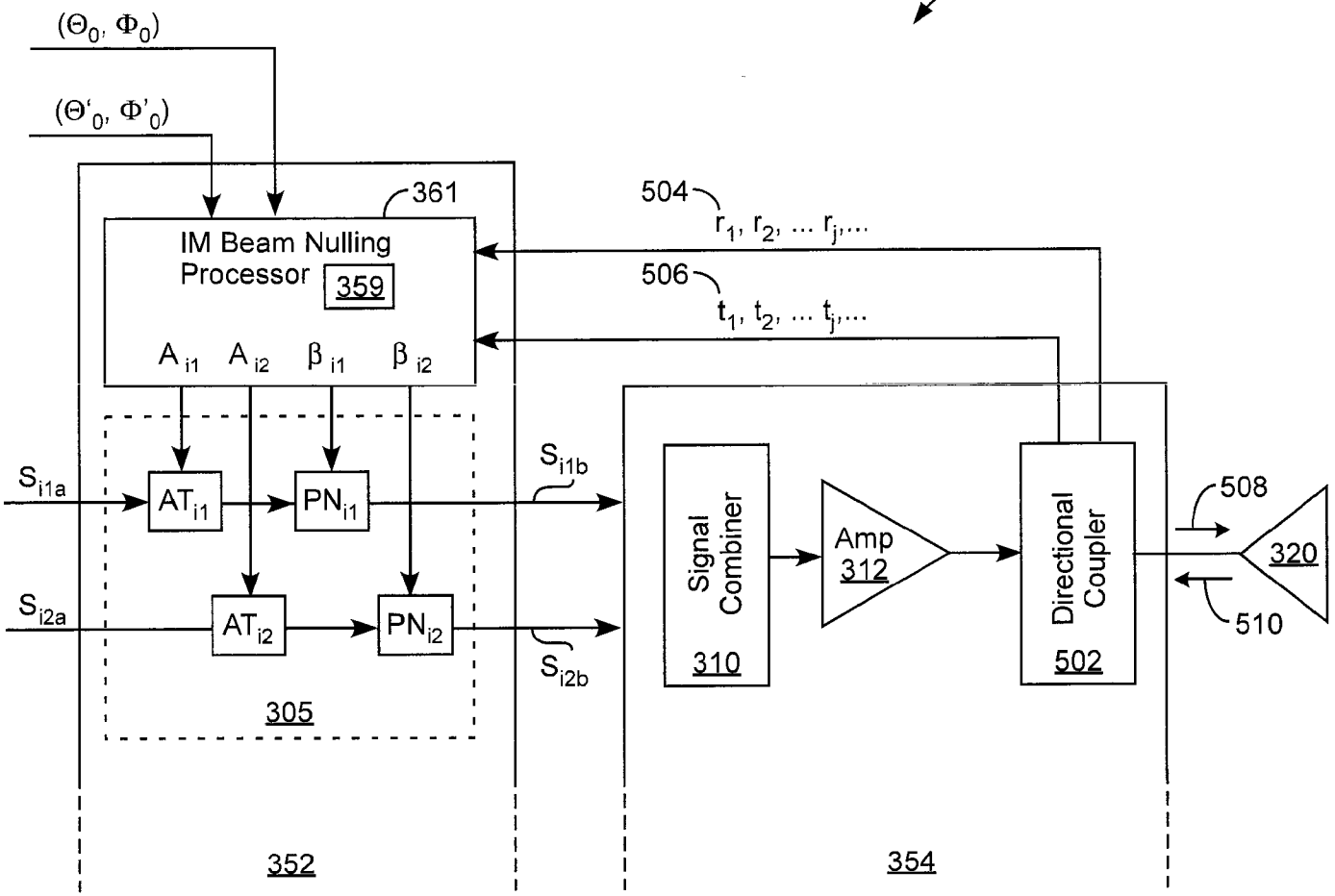
FIG. 5 shows an enhanced version of the block diagram of FIG. 3A.

FIG. 5 shows a portion of an active array antenna system including radiator feedback 500. Here, an $i^{th}$ directional coupler 502 is coupled between an $i^{th}$ amplifier 312 and an $i^{th}$ radiator 320. The directional coupler exchanges signals 508, 510 with the radiator 320. The directional coupler samples fundamental and IM forward ($t_1, t_2, \ldots, t_j, \ldots$) and reflected ($r_1, r_2, \ldots, r_j, \ldots$) traveling wave signal levels at the input of each antenna radiator. These samples are inputs to the IM beam nulling processor 504, 506. Notably, traveling wave signal level changes and in particular increased reflected traveling wave signal levels typically indicate radiator degradation, and, where significant, indicates a need for updating stored pattern values P.

Radiator degradation modifies the radiator's complex excitation coefficient $I_{mn}$. As shown above, a radiator's modified excitation coefficient changes values of directivity D that were earlier stored as pattern values P. In essence, actual pattern values change as radiators degrade and stored pattern values are updated to maintain the performance of the nulling system.

Figure 6A:
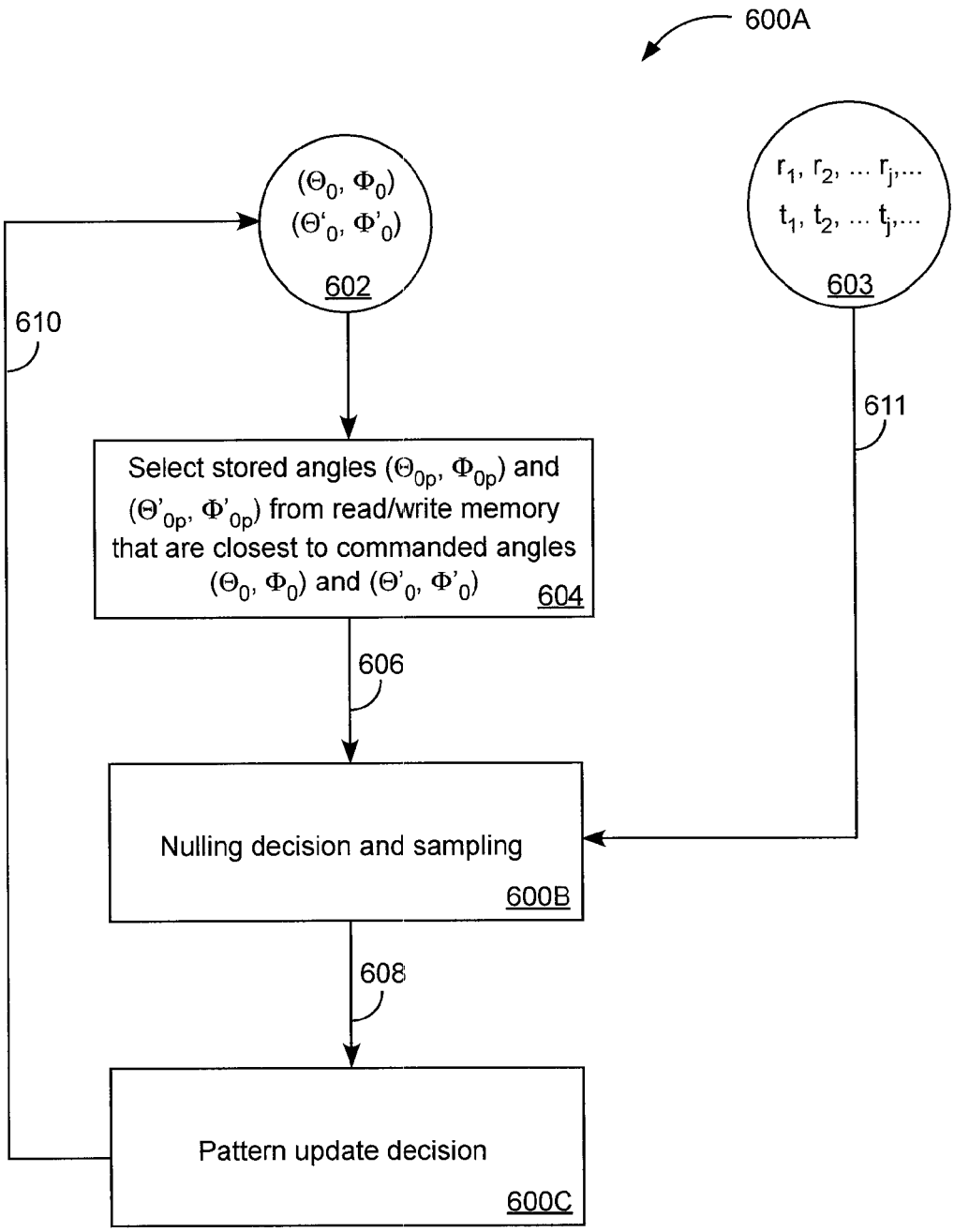
FIGS. 6A-C show a method of operation of a phased array antenna such as the antenna of FIG. 3A.
Figure 6B:
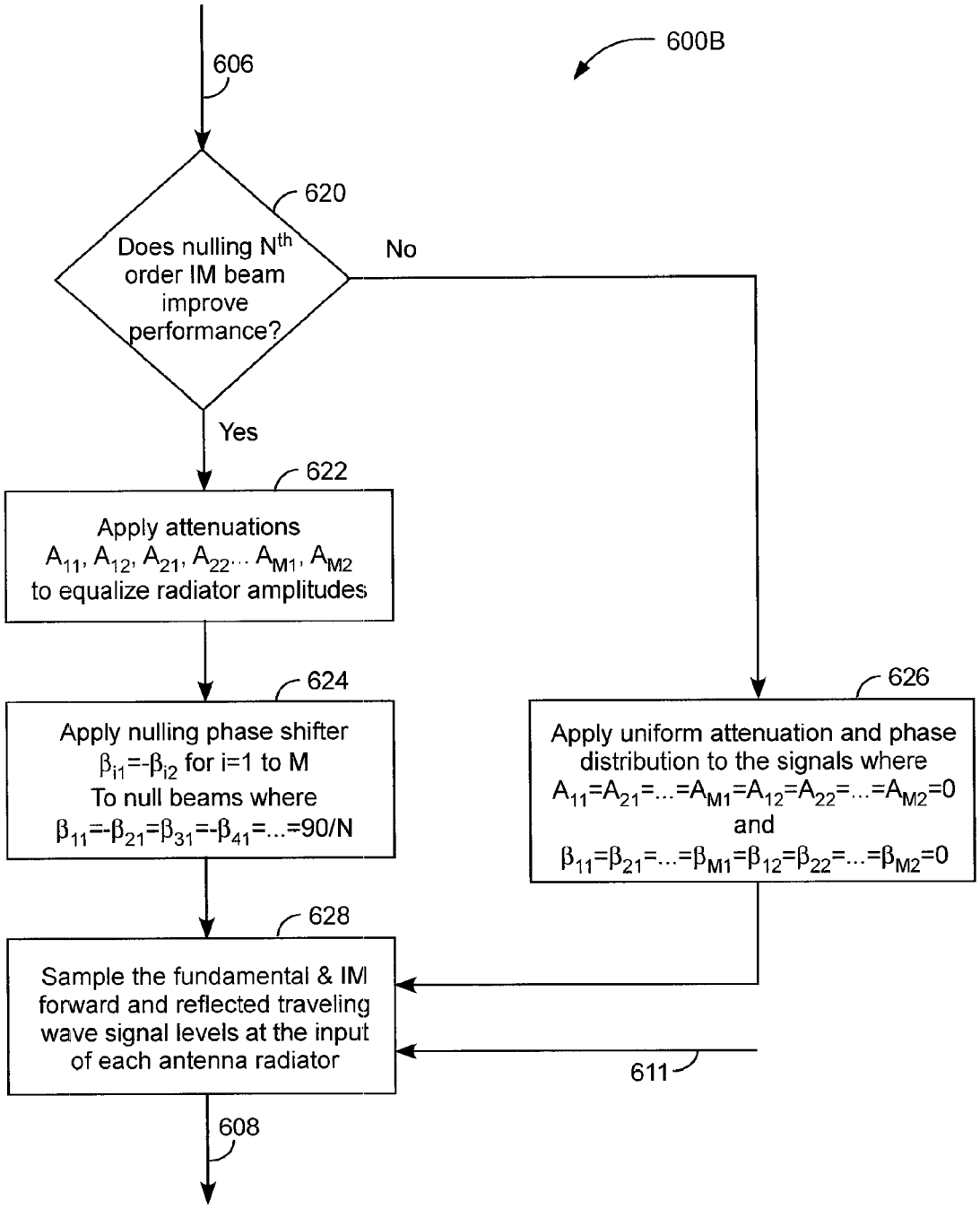
Figure 6C:
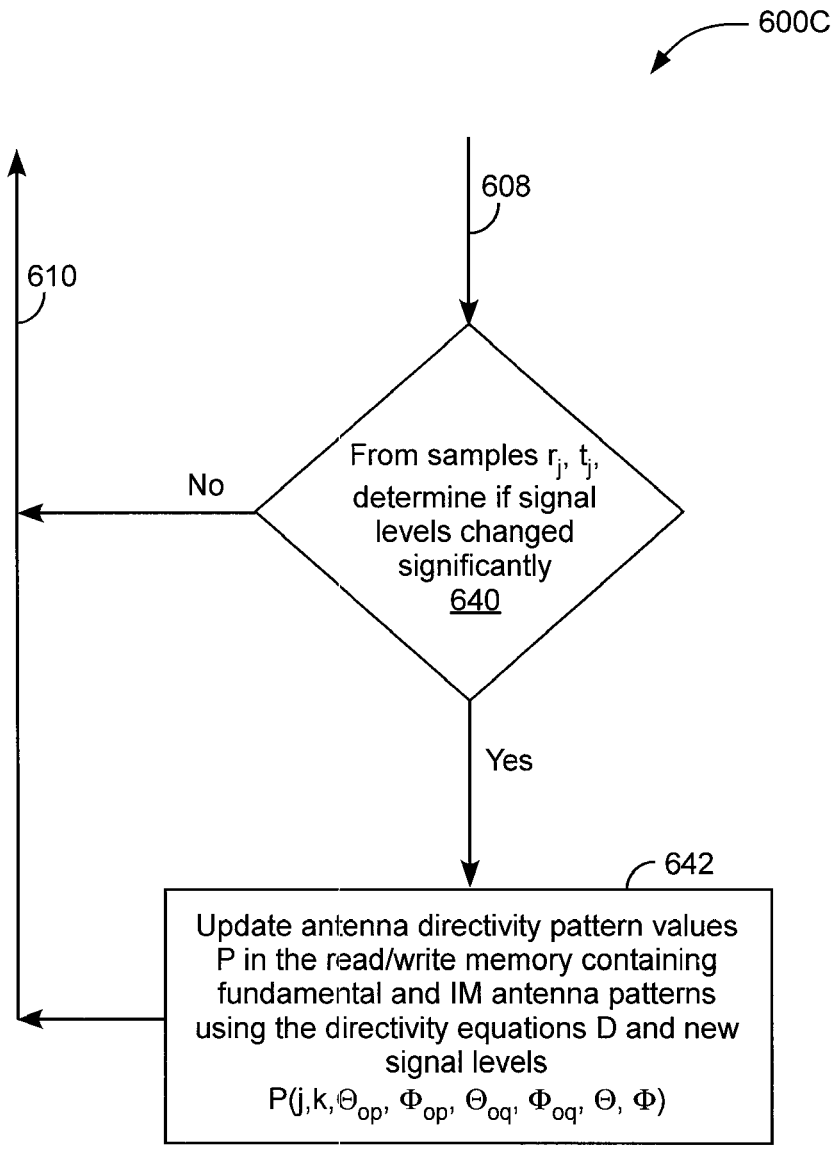

FIGS. 6A-C show flowcharts implementing nulling and pattern value updating 600A-C. In FIG. 6A, commanded angles ($\theta_0$, $\phi_0$), ($\theta'_0$, $\phi'_0$) are inputs 602 to a selection block 604 that matches the commanded angles with the closest (or interpolated) angles ($\theta_{0p}$, $\phi_{0p}$), ($\theta'_{0q}$, $\phi'_{0q}$) in a pattern storage device such as the one discussed above 359. A nulling decision and sampling block 600B is coupled 606 to the selection block and is coupled 611 to sample inputs 603 including ($r_1$, $r_2, \ldots, r_j, \ldots$) and ($t_1, t_2, \ldots, t_j, \ldots$). A pattern update decision block 600C is coupled 608 to the nulling decision and sampling block. When the pattern decision and update, if any, is completed, another commanded angle input is ready to be accepted 610.

FIG. 6B shows a more detailed flowchart of the nulling decision and sampling function 600B. A decision block 620 is coupled 606 to the selection block 604. If performance is improved by nulling (k=1), then a) the first attenuation block 622 applies attenuations $A_{11}$, $A_{12}, A_{21}, A_{22} \ldots A_{M1}, A_{M2}$ to equalize radiator amplitudes and b) the nulling phase shifter block 624 applies phase shifts such that $\beta_{i1}=-\beta_{i2}$ for i=1 to M to null beams where $\beta_{11}=-\beta_{21}=\beta_{31}=-\beta_{41}=\ldots=90°/N$ Sampling block 628 follows the nulling phase shifter block 624 and samples the forward and reflected traveling wave signal levels at the input of each antenna radiator as discussed above. The sampling block is coupled 608 to the pattern update decision block 600C.

If performance is not improved by applying a checkerboard nulling phase distribution, flow passes from decision block 620 to attenuation block 626 where a uniform attenuation and phase distribution is applied to the signals where $A_{11}=A_{21}=\ldots=A_{M1}=A_{12}=A_{22}=\ldots=A_{M2}=0$ and $\beta_{11}=\beta_{21}=\ldots=\beta_{M1}=\beta_{12}=\beta_{22}=\ldots=\beta_{M2}=0$.

FIG. 6C shows a more detailed flowchart of the pattern update decision block 600C. The sampling block is coupled 608 to a pattern update decision block 640 that determines whether the fundamental or IM forward and reflected traveling wave signal levels at the input of an antenna radiator have changed significantly. A significant change is one which has been determined a priori to significantly change the directivity.

If there is no significant change, then the process 600A is ready to accept another set of commanded angles 610. If there is a significant change, control passes to the pattern update process 642 which updates the antenna directivity patterns in read/write memory 359 containing fundamental and intermodulation antenna patterns using the directivity equation D and the new signal levels P(j, k, $\theta_{0p}$, $\phi_{0p}$, $\theta'_{0q}$, $\phi'_{0q}$, $\theta$, $\phi$).

After pattern updating is completed, the process 600A is ready to accept another set of commanded angles 610.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

APPENDIX

1.0 Checkerboard Nulling Phase Distribution

Figure 1:
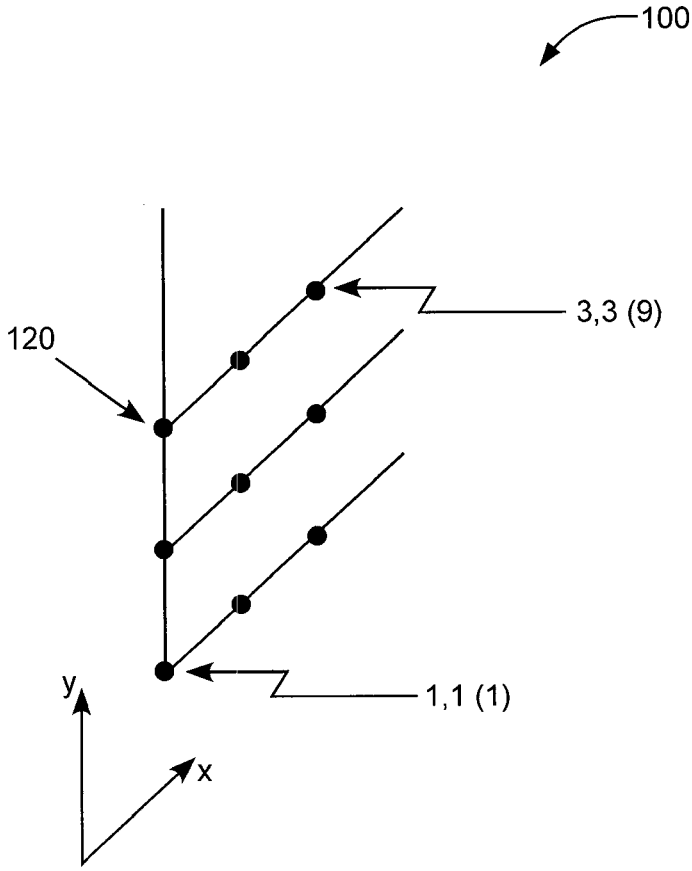
FIG. 1 (Prior Art)
FIG. 1 shows a schematic diagram of a prior art rectangular antenna array.

Figure 1 shows a feed chain using a checkerboard phase distribution for intermodulation beam nulling. To understand the effects of checkerboard phase distributions on Nth-order intermodulation beams, consider two fundamental signals represented by sine wave functions as $$S_1(t) = \sin(\omega_1 t + \phi_1)$$

$$S_2(t) = \sin(\omega_2 t + \phi_2) \tag{1}$$

The functional form of associated Nth-order nonlinearities is revealed by constructing the function g(t) given by $$g(t) = [S_1(t) + S_2(t)]^N \tag{2}$$

It is instructive to expand the right hand side of equation (2) so that all terms consist of sinusoids having arguments that are either integer multiples, sums of integer multiples, or differences of integer multiples of $(\omega_1 t + \phi_1)$ and $(\omega_2 t + \phi_2)$. The terms expected to be the most detrimental in a communication system are those sinusoids $S_N$(T) and $S'_N$(T) with N odd and having arguments that are differences of consecutive integer multiples, i.e., $$S_N(t) = \sin\left[\left(\frac{N+1}{2}\right)(\omega_1 t + \phi_1) - \left(\frac{N-1}{2}\right)(\omega_2 t + \phi_2)\right]$$

$$S'_N(t) = \sin\left[\left(\frac{N+1}{2}\right)(\omega_2 t + \phi_2) - \left(\frac{N-1}{2}\right)(\omega_1 t + \phi_1)\right] \tag{3}$$

Further, if $$\phi_2 = -\phi_1 = \phi \tag{4}$$

Then the functions given in equation (3) become $$S_N(t) = \sin\{\left[\left(\frac{N+1}{2}\right)\omega_1 - \left(\frac{N-1}{2}\right)\omega_2\right]t - N\phi\}$$

$$S'_N(t) = \sin\{\left[\left(\frac{N+1}{2}\right)\omega_2 - \left(\frac{N-1}{2}\right)\omega_1\right]t + N\phi\} \quad (5)$$

Equation (5) reveals that the magnitude of the phase constants $\phi_N$ and $\phi'_N$ of detrimental Nth-order intermodulation beams is simply N times that of the fundamental functions from which they are generated. Because the resulting phase excitation of each element for these Nth-order intermodulation signals is N times the phase excitation for the fundamental signals, the checkerboard phase distributions for any pair of Nth-order intermodulation beams can be obtained from Fig. 2 by replacing $\phi$ with $N\phi$.

To replace the Nth-order intermodulation boresight beams with nulls, the value of $\phi$ is chosen as $$\phi = 90°/N \quad (6)$$

This causes the phase excitations $\phi_N$ and $\phi'_N$ for the Nth-order intermodulation boresight beams to all become either +90° or -90°. To understand why the intermodulation beams are replaced with nulls, one can view the array as a collection of overlapping square subarrays, where each subarray consists of a group of four adjacent elements that are excited with alternate phases of +/- 90°, as shown in Fig. 3. At boresight, the two diagonal pairs of elements produce patterns that are identical in amplitude but 180° out of phase, resulting in a null, as shown in Fig. 3. Since the array consists of many of these subarrays, there is no significant radiation in the boresight direction, and typical pattern cuts for fundamental and intermodulation boresight beams are illustrated in Fig. 4.

The typical nulling capability of the invention was evaluated for a 14 x 14 spot beam array that might be employed to achieve Earth-coverage communication from a geosynchronous satellite. The array layout and element pattern are shown in Fig. 5. The elements were assumed to be identical, excited uniformly in amplitude, and laid out on a square grid with a spacing of 2.5 wavelengths. The pattern of each element was modeled using a circularly symmetric J1(u)/u function. The element pattern peak directivity was 21.1 dB and decreased by 3 dB at the edge of the Earth, which was assumed to be 8.6° from the antenna boresight. All directivity patterns of the array were generated using the satellite industry standard software General Reflector Antenna and Antenna Farm Analysis Program (GRASP).

The fundamental and intermodulation boresight beams prior to applying the checkerboard phase distributions are shown in Fig. 6. The peak directivity is 41.69 dB, and the sidelobes roll off in a sin(x)/x fashion consistent with the uniform amplitude distribution. The pattern of the fundamental boresight beams after applying checkerboard phase distributions with $\phi = 30°$ is shown in Fig. 7. The pattern can be seen to be virtually identical to that of Fig. 6, with the only significant difference being a 0.25 dB decrease in peak directivity to 41.44 dB.

The effect of the nulling phase distributions on a fundamental beam depends on the desired fundamental beam scan angle $\theta_0$ as well as the nulling phase $\phi$. This dependence is shown in Fig. 8, in which the resulting degradation in directivity of a fundamental beam within the desired +/- 0.5° spot is plotted as a function of $\theta_0$ and $\phi$. When the fundamental beam is on boresight, the maximum degradation of 0.25 dB occurs when the third-order intermodulation beams are targeted with $\phi = 30°$. The degradation decreases rapidly as one targets increasingly higher-order beams.

The pattern of the Nth-order intermodulation boresight beams after applying checkerboard phase distributions using $\phi = 90°/N$ is shown in Fig. 9. It is seen that the directive intermodulation beam shown in Fig. 6 has been eliminated, and the Earth field of view has been covered with many low-level beams. The pattern is displayed in a different form in Fig. 10, which contains forty-five pattern cuts for $0 < \theta < 8.6°$ taken at 1° increments in azimuth. Also, the highest directivities within the fundamental spot beam region and within the full angle substended by the Earth's disc are -3 dB and 7 dB respectively. These numbers may be compared with the intermodulation beam peak directivity of 41.7 dB before applying the checkerboard phase distributions.

If digital, rather than analog phase shifters are employed, errors associated with quantization may degrade performance. For example, if eight bits are used to control each phase shifter, the realized values for $\phi_N$ for the third-, fifth-, seventh-, and ninth-order patterns are shown in Fig. 11. In all four cases, the magnitude of the phase error for $\phi_N$ is identical and equal to the magnitude represented by the least significant bit.

The third-, fifth-, seventh-, and ninth-order pattern when using eight-bit phase shifters is shown in Fig. 12. A boresight beam is present, but has a peak directivity of only 16.9 dB. This number should again be compared with the intermodulation beam peak directivity of 41.7 dB before applying checkerboard phase distributions.

Scanning of the fundamental boresight beams to the desired communication fields of view generally results in scanning of the intermodulation boresight beams as well. If the intermodulation boresight beams happen to scan near one of the desired communication fields of view, application of nulling phase distributions can improve performance significantly. On the other hand, if the intermodulation boresight beams do not scan near the desired communication fields of view, application of nulling phase distributions may not be necessary, and could even degrade performance. Therefore, a decision whether to apply nulling phase distributions must be made for each particular situation.

Consider the two fundamental boresight beams produced by the array of Fig. 5 scanned to angular locations $(\theta_0, \phi_0)$ and $(\theta'_0, \phi'_0)$ by applying the uniform progressive phases $(\alpha_{1,x}, \alpha_{1,y})$ and $(\alpha'_{1,x}, \alpha'_{1,y})$ respectively given the equations $$\begin{aligned} tan\phi_0 &= \frac{\alpha_{1,y}}{\alpha_{1,x}} \\ sin^2\theta_0 &= \frac{\alpha_{1,x}^2 + \alpha_{1,y}^2}{(2\pi d/\lambda)^2} \\ tan\phi'_0 &= \frac{\alpha'_{1,y}}{\alpha'_{1,x}} \\ sin^2\theta'_0 &= \frac{\alpha'^2_{1,x} + \alpha'^2_{1,y}}{(2\pi d/\lambda)^2} \end{aligned} \tag{7}$$

where $d/\lambda$ = 2.5 as indicated in Fig. 5.[1] As a result the two detrimental Nth order intermodulation boresight beams will be scanned due to the uniform progressive phases $(\alpha_{N,x}, \alpha_{N,y})$ and $(\alpha'_{N,x}, \alpha'_{N,y})$ given by

[1] Note, these equations assume dx = dy = d. This assumption simplifies the analysis and the equations.

$$\alpha_{N,x} = \frac{N+1}{2}\alpha_{1,x} - \frac{N-1}{2}\alpha'_{1,x}$$

$$\alpha_{N,y} = \frac{N+1}{2}\alpha_{1,y} - \frac{N-1}{2}\alpha'_{1,y}$$

$$\alpha'_{N,x} = \frac{N+1}{2}\alpha'_{1,x} - \frac{N-1}{2}\alpha_{1,x} \tag{8}$$

$$\alpha'_{N,y} = \frac{N+1}{2}\alpha'_{1,y} - \frac{N-1}{2}\alpha_{1,y}$$

In an example, two fundamental boresight beams are scanned due east by 4° and 5° using x-directed uniform progressive phases of −63° and −78° respectively. Consequently, the two third-order intermodulation boresight beams are also scanned due east, by 3° and 6°, because of the x-directed uniform progressive phases of −48° and −93° respectively. The two fundamental beams are shown along with the two third-order intermodulation beams for the cases in which nulling phase distributions have not and have been applied in Figs. 13 and 14 respectively. It is clear from Figs. 13 and 14 that performance improves if nulling phase distributions are applied.

In another example, one of the fundamental boresight beams is scanned southwest by 4.1°, while the other is scanned northeast by 4.1°. Here, one of the third-order intermodulation boresight beams is scanned southwest beyond the edge of the Earth while the other is scanned northeast beyond the edge of the Earth. The two fundamental beams are shown along with the two third-order intermodulation beams for the cases in which nulling phase distributions have not and have been applied in Figs. 15 and 16 respectively. It is clear from Figs. 15 and 16 that performance degrades considerably if nulling phase distributions are (inappropriately) applied.

2.0 Directivity Computation

Consider a planar array arranged in a rectangular grid, and having a rectangular boundary. Let there be $(2N_x + 1)$ rows, and each row will contain $(2N_y + 1)$ elements. Each row is parallel to the y-axis with common spacing $d_x$ between rows and elements of the rows are spaced apart by a common spacing $d_y$. The complex (amplitude and phase) excitation of the $mn^{\text{th}}$ element will be designated $I_{mn}$. Using this notation, the array factor is given by $$A_a(\theta,\phi)=\sum_{m=-N_x}^{N_x}\sum_{n=-N_y}^{N_y} I_{mn} e^{jk\sin\theta[(m)d_x\cos\phi+(n)d_y\sin\phi]}$$

To simplify the expression for the directivity computation, it will be assumed that the array element factor (which represents the radiation pattern of a single array element) is a constant, or in other words that the element pattern does not vary with $\theta$ or $\phi$. The equation for the directivity of the array is then given by $$D(\theta,\phi)=\frac{4\pi A_a(\theta,\phi)A_a^*(\theta,\phi)}{\int_0^{\pi/2}\int_0^{2\pi} A_a(\theta,\phi)A_a^*(\theta,\phi)\sin\theta d\theta d\phi}$$

3.0 Summary

In summary, special phase distributions are shown to eliminate undesirable higher-order intermodulation beams caused by nonlinear effects in multiple-beam communication systems. Applying the "checkerboard" phase distributions results in the degeneration of a highly directive intermodulation beam to a pattern consisting of many low-level beams interspersed with nulls. Typical performance is demonstrated for a 14 x 14 array that might be employed on a geosynchronous satellite. Using analog phase shifters, 35 dB degradation in the intermodulation beam directivity over the Earth field of view is achievable. Using eight-bit digital phase shifters, the directivity can be degraded by 25 dB. This can be achieved with high efficiency, because fundamental communication beams can experience a peak directivity degradation of just 0.25 dB or less. These special distributions are not applied statically, but rather are applied in a dynamic, semi-adaptive manner as the fundamental boresight beams are scanned, based upon a priori knowledge of the intermodulation beam scan angle dependence on the fundamental beam scan angles.

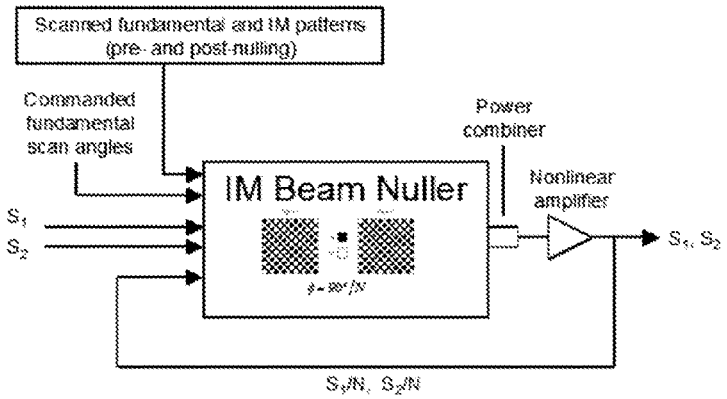
Figure 1. Single feed chain for a semi-adaptive intermodulation beam nulling antenna system.
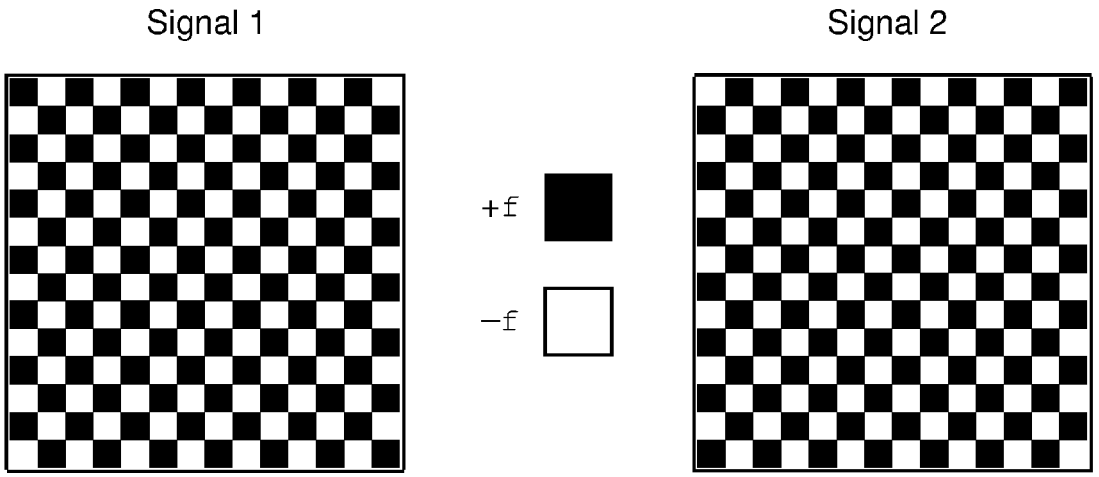
Figure 2. Checkerboard phase distributions for a 14 × 14 array.

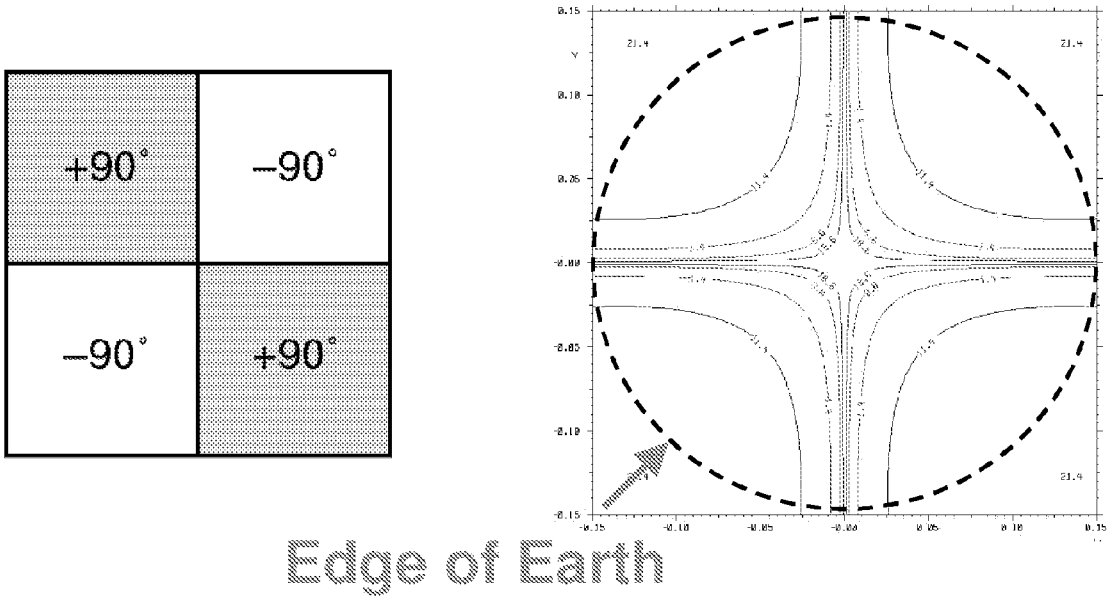
**Figure 3. Four-element subarray *N*th-order phase distribution and pattern.**
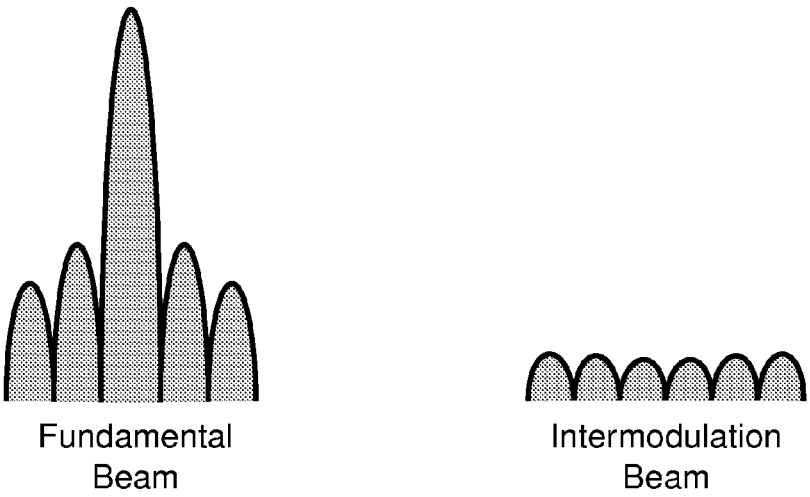

**Figure 4. Typical pattern cuts for the fundamental and *n*th-order intermodulation boresight beams when checkerboard phase distributions are applied.**
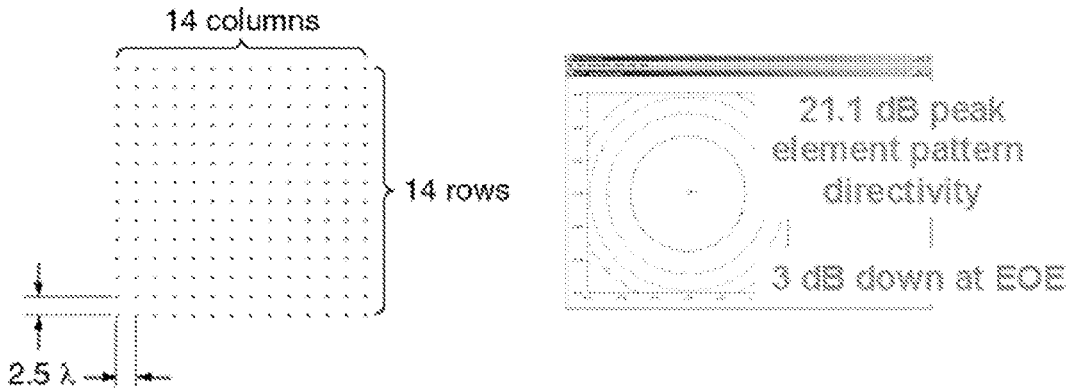
Figure 5. 14 × 14 array geometry and $J_1(u)/u$ element pattern employed to demonstrate performance.

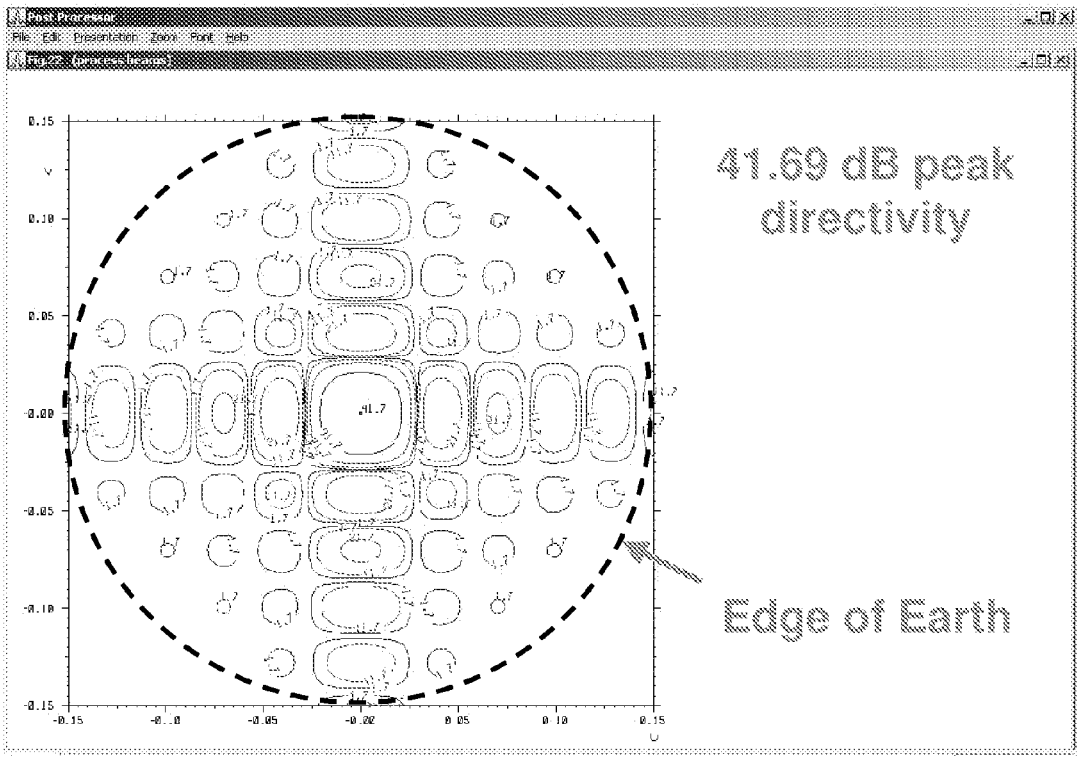
Figure 6. Pattern of the fundamental and intermodulation boresight beams before applying checkerboard phase distributions.

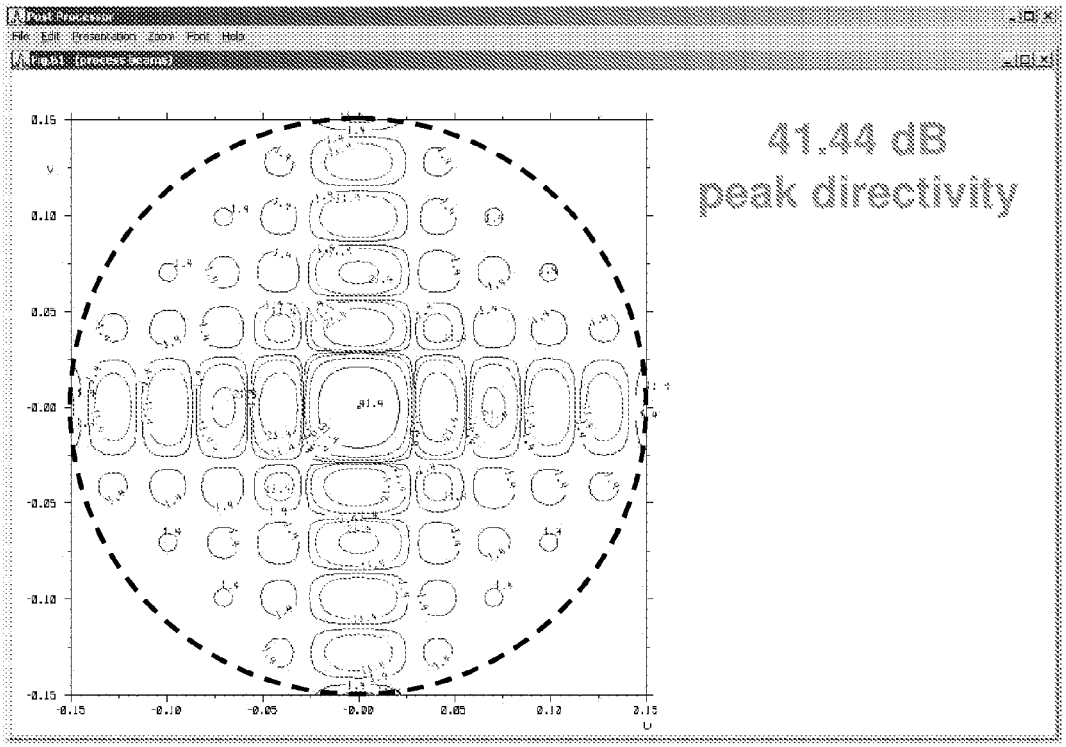
Figure 7. Pattern of the fundamental boresight beams after applying checkerboard phase distributions using $\phi = 30^{\circ}$.

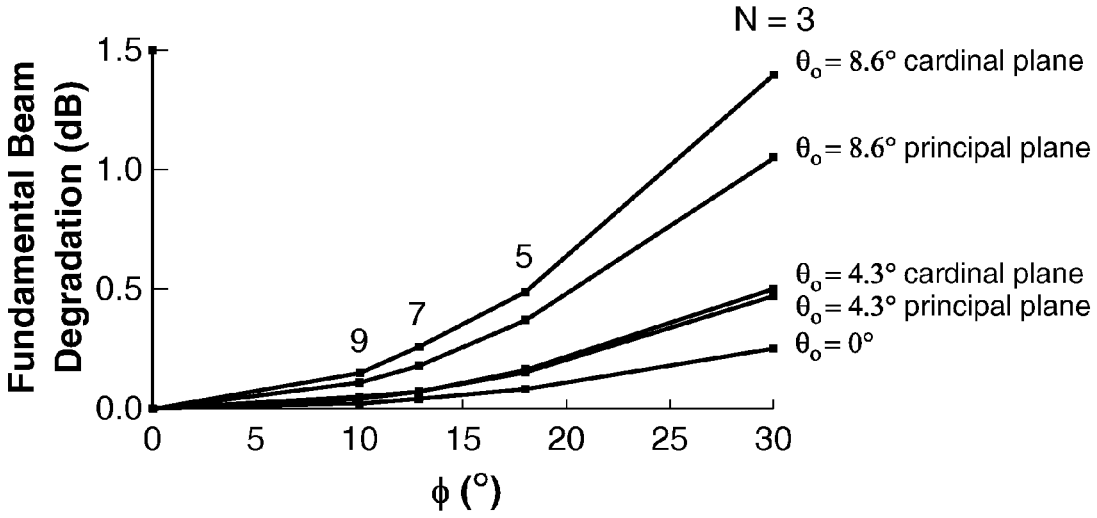
Figure 8. Directivity degradation within the ±0.5° fundamental spot beam due to applying checkerboard phase distributions.

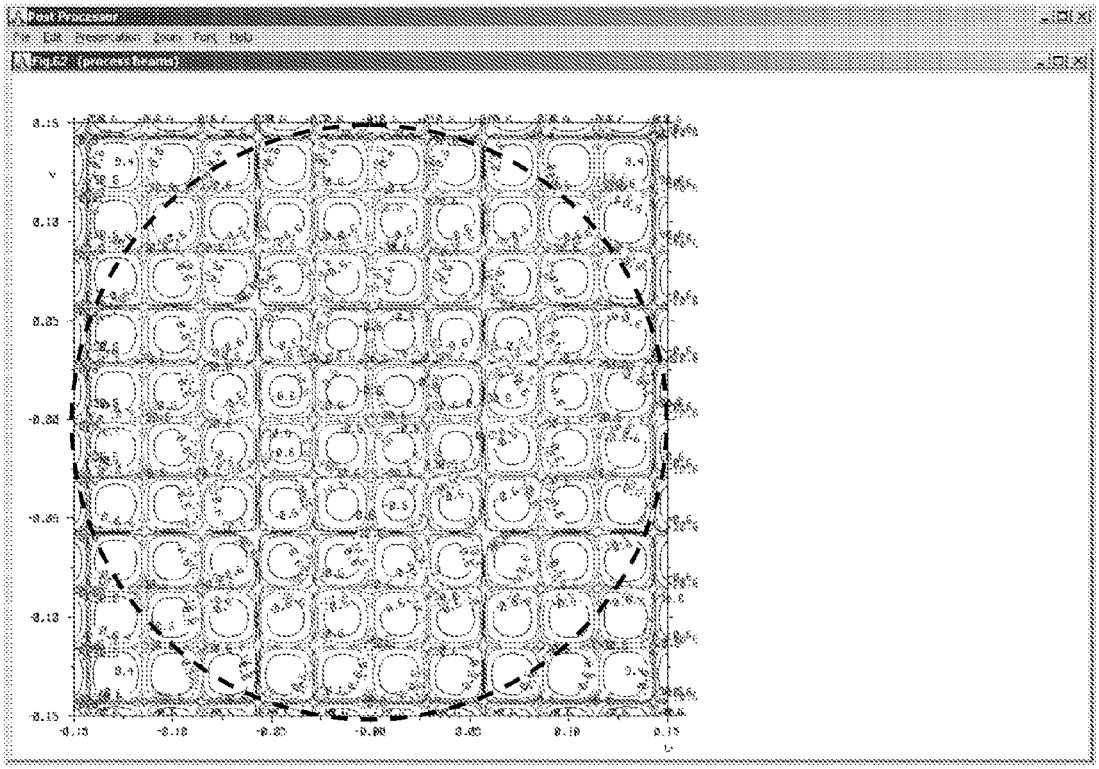
**Figure 9. Pattern of the *N*th-order intermodulation boresight beams after applying checkerboard phase distributions using $\phi = 90^{\circ}/N$.**

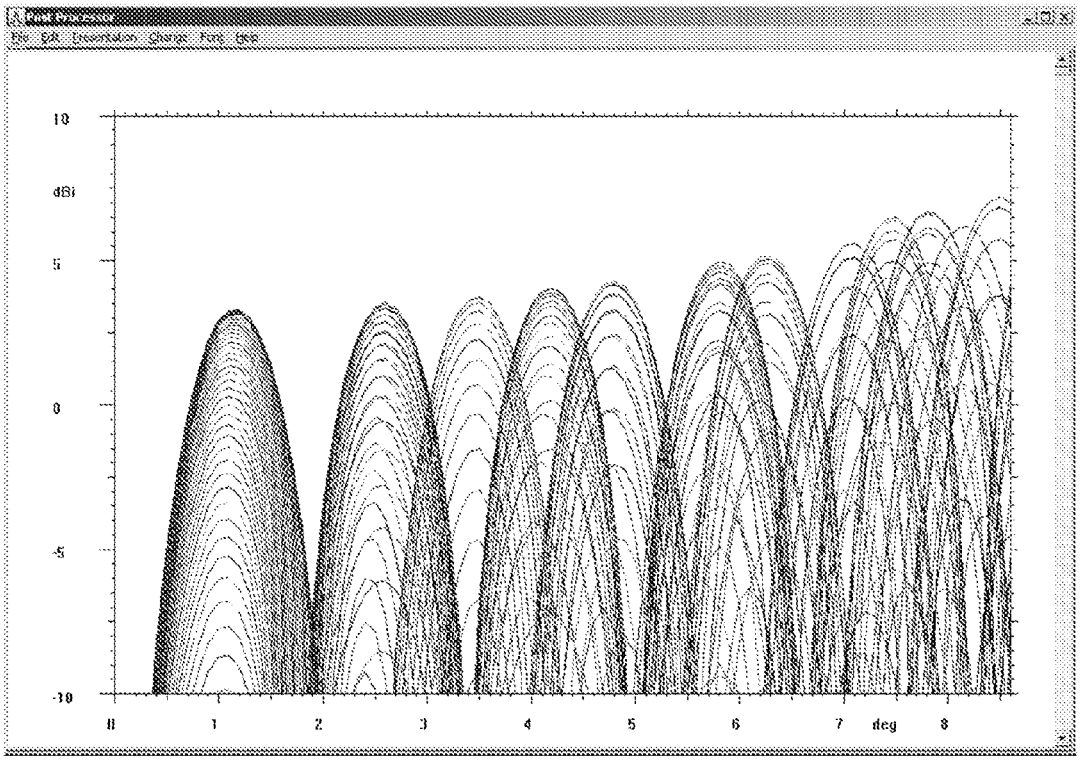
**Figure 10. Forty-five *N*th-order intermodulation pattern cuts plotted for $0 < \theta < 8.6°$ at 1° azimuth intervals.**

| Targeted Intermodulation Order n | 3 | 5 | 7 | 9 |
|---|---|---|---|---|
| Ideal Phase f (deg) | 30 | 18 | 12.9 | 10 |
| Ideal Phase $f_n$ (deg) | 90 | 90 | 90 | 90 |
| 8-bit Phase $f_n$ (deg) | 88.6 | 91.4 | 88.6 | 88.6 |

Figure 11. Ideal and quantized eight-bit digital phase shifts for implementation.

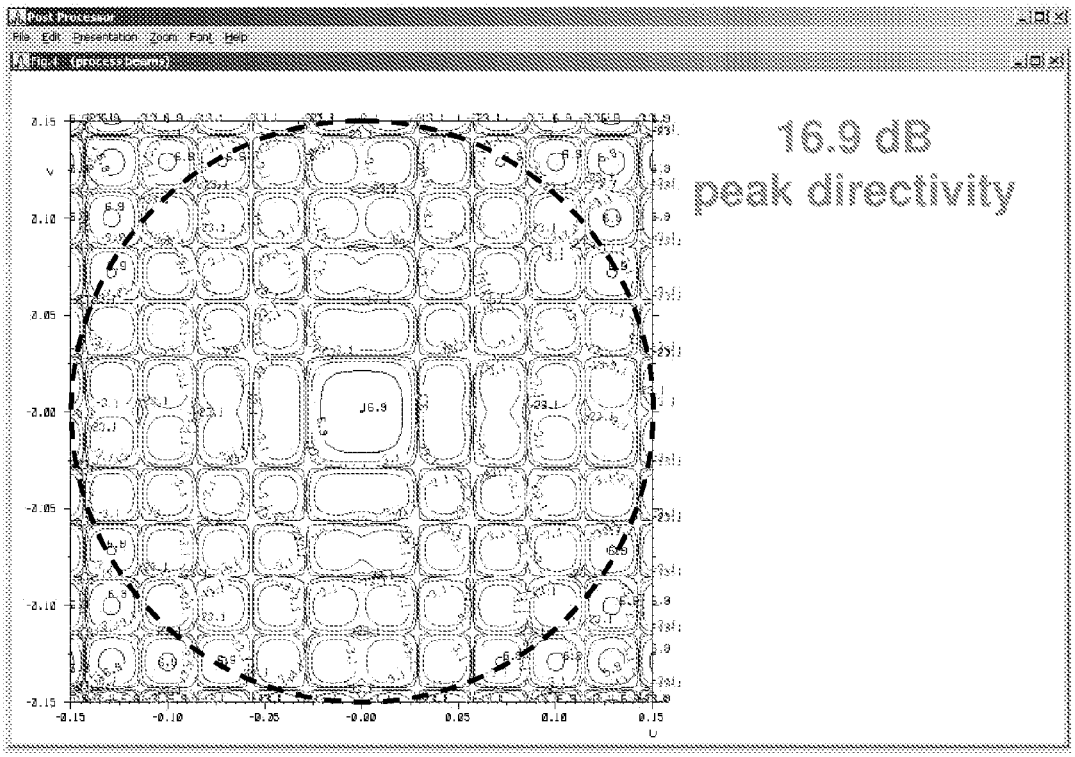
Figure 12. Pattern of the third-, fifth-, seventh- and ninth-order intermodulation boresight beams when eight-bit digital phase shifters are used.

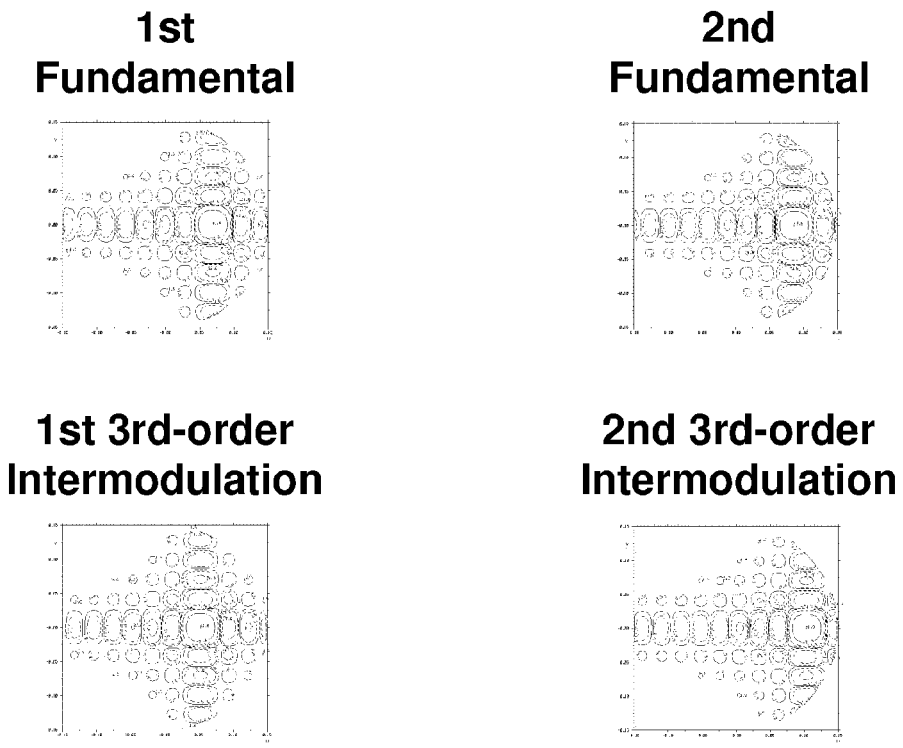
Figure 13. Patterns of the fundamental and third-order intermodulation boresight beams when the fundamental beams are scanned to 4° and 5° due East respectively.

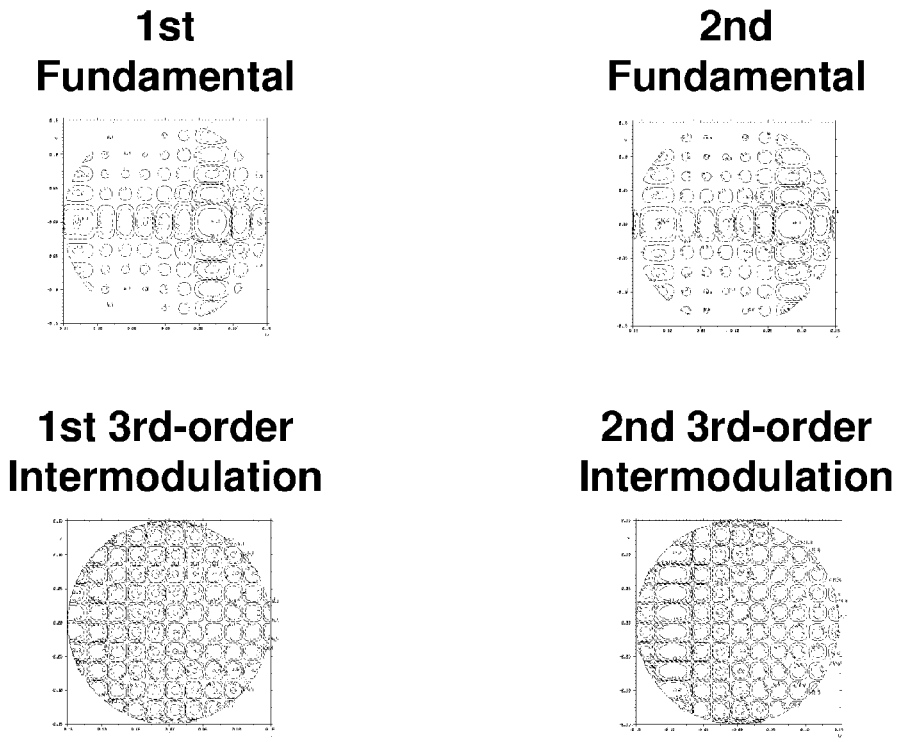
Figure 14. Patterns of the fundamental and third-order intermodulation boresight beams of Fig. 13 after checkerboard phase distributions are applied.

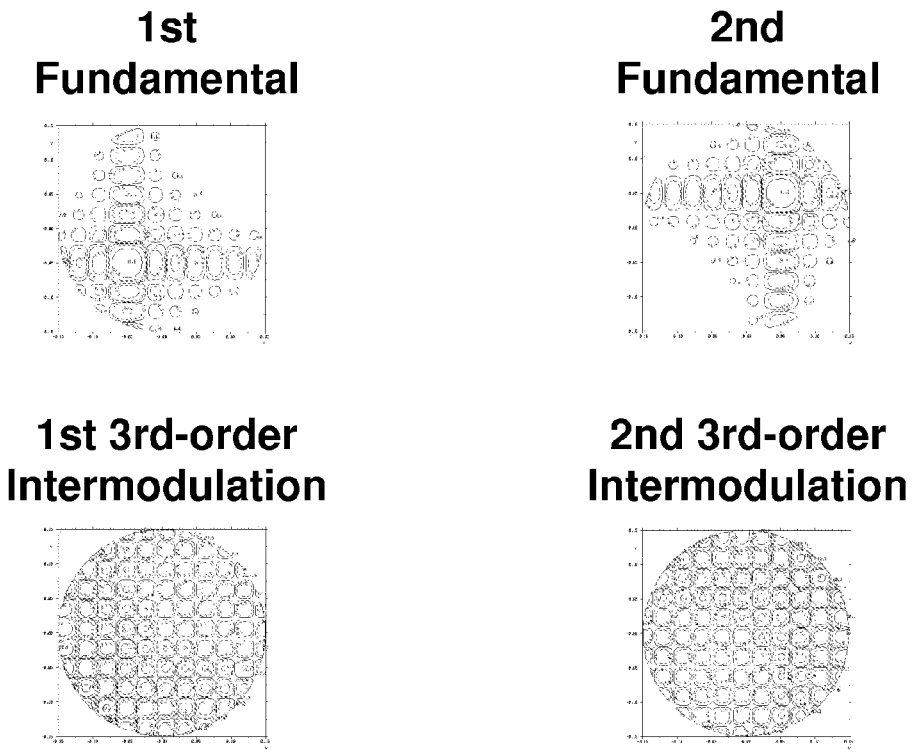
Figure 15. Patterns of the fundamental and third-order intermodulation boresight beams when the fundamental beams are scanned to 4.1° Southwest and 4.1° Northeast respectively.

What is claimed is:

1. A phased array antenna system comprising:

a nulling section interposed between a beam forming section and a feed chain section;

the nulling section configured to shift the phases of plural signals by a nulling angle with a magnitude of 90/N where N is the order of the intermodulation beam to be nulled;

an antenna having a plurality of radiators, each radiator coupled to a respective amplifier in the feed chain section;

each amplifier coupled to a respective nulling phase shifter in the nulling section;

each nulling phase shifter coupled to a respective steering phase shifter in the beam forming section;

one or more processors for activating the nulling and steering phase shifters; and, the phased array antenna system configured to simultaneously transmit a plurality of signals to respective locations.

2. The phased array antenna system of claim 1 further including:

one or more processors for calculating directivity patterns;

one or more memory devices for storing calculated directivity patterns;

a signal sampler for sampling fundamental and intermodulation forward and reflected traveling wave signal levels at the input of each radiator; and, one or more processors for updating the stored directivity patterns in accordance with the sample values.

3. The phased array antenna system of claim 2 wherein a signal processor is used.

4. The phased array system of claim 2 wherein the one or more processors for activating the nulling and steering phase shifters comprise at least one beam forming section processor and at least one nulling section processor.

5. A method of nulling an intermodulation beam in a phased array antenna system comprising the steps of:

providing a nulling section interposed between a beam forming section and a feed chain section;

the nulling section configured to shift the phases of plural signals by a nulling angle with a magnitude of 90/N where N is the order of the intermodulation beam to be nulled;

providing an antenna having a plurality of radiators, each radiator coupled to a respective amplifier in the feed chain section;

coupling each amplifier to a respective nulling phase shifter in the nulling section;

coupling each nulling phase shifter to a respective steering phase shifter in the beam forming section;

activating the nulling and steering phase shifters with one or more processors; and, the phased array antenna system simultaneously transmitting a plurality of signals to respective locations.

6. The method of claim 5, further including the steps of:

calculating directivity patterns with one or more processors;

storing calculated directivity patterns in one or more memory devices;

sampling with a signal sampler fundamental and intermodulation forward and reflected traveling wave signal levels at the input of each radiator; and, updating the stored directivity patterns in accordance with the sample values with one or more processors.

7. The method of claim 6 further wherein the step of calculating directivity patterns is performed with a single processor.

8. The method of claim 6 further comprising the steps of:

utilizing separate processors to activate the nulling and steering phase shifters.

9. A phased array antenna system comprising:

a combined nulling and beam forming section coupled to a feed chain section;

the combined nulling and beam forming section configured to shift the phases of plural signals by a nulling angle with a magnitude of 90/N where N is the order of the intermodulation beam to be nulled;

an antenna having a plurality of radiators, each radiator coupled to a respective amplifier in the feed chain section;

each amplifier coupled to a respective phase shifter in the combined nulling and beam forming section;

a processor configured to combine a steering and a nulling phase shift, the combined phase shift applied to a respective phase shifter; and, the phased array antenna system configured to simultaneously transmit a plurality of signals to respective locations.

10. A phased array antenna system comprising:

a nulling section;

the nulling section configured to apply a nulling phase distribution to signals passing therethrough; and, the nulling phase distribution shifting the phases of plural signals by a nulling angle with a magnitude of 90/N where N is the order of the intermodulation beam to be nulled.

* * * * *